US005146211A

United States Patent [19]

Adams et al.

[11] Patent Number: 5,146,211

[45] Date of Patent: Sep. 8, 1992

[54] BIT MAPPED COLOR CURSOR

[75] Inventors: John M. Adams; Brian K. Herbert; Stephen M. Johnson; Jamey L. Robbins, all of Colorado Springs, Colo.

[73] Assignee: NCR Corporation, Dayton, Ohio

[21] Appl. No.: 566,014

[22] Filed: Aug. 10, 1990

[51] Int. Cl.[5] ..... G09G 1/00

[52] U.S. Cl. ..... 340/709; 340/721

[58] Field of Search ..... 340/709, 721, 723, 724, 340/725, 726

[56] References Cited

U.S. PATENT DOCUMENTS

| | | | |
|---|---|---|---|
| Re. 31,200 | 4/1983 | Sukonick et al. | 340/724 |
| 4,190,834 | 2/1980 | Doornink | 340/209 |
| 4,354,184 | 10/1982 | Woborschil | 340/709 |
| 4,454,507 | 6/1984 | Srinivasan et al. | 340/744 |
| 4,533,910 | 8/1985 | Sukonick et al. | 340/721 |
| 4,566,000 | 1/1986 | Goldman et al. | 340/709 |
| 4,625,202 | 11/1986 | Richmond et al. | 340/709 |
| 4,668,947 | 5/1987 | Clarke, Jr. et al. | 340/709 |
| 4,706,074 | 11/1987 | Mukich | 340/709 |
| 4,835,526 | 5/1989 | Ishii et al. | 340/709 |

OTHER PUBLICATIONS

Daniel H. H. Ingalls, "The Smalltalk Graphics Kernel" of Byte Publications Inc., Aug. 1961, pp. 168–194.

"Fundamentals of Interactive Computer Graphics" by Foley et al., 1982, pp. 144–153.

*Primary Examiner*—Jeffery A. Brier

*Assistant Examiner*—Jick Chin

*Attorney, Agent, or Firm*—Jack R. Penrod

[57] ABSTRACT

An architecture for generating a hardware cursor in the context of a bit mapped video display system operable from a frame buffer with non-displayed but addressable memory space. A segment of the non-displayed memory is loaded with cursor information controlling the generation of its outline and its color pattern. When accessed, this cursor control data is accessed from the non-displayed segment of the memory during each horizontal blank time preceding the raster scan of the video pattern data subject to cursor overlay. Location of the cursor within the video display is determined by a group of position registers which are loaded by the CPU with cursor position data during the vertical blank time. The position registers in conjunction with a group of counters coordinate the insertion of the cursor data into a byte stream of display data as it makes its way to the CRT screen. This display data is stored in the frame buffer and is transferred to the pixel output buffer. The display data in the pixel output buffer is subsequently interpreted into colors and intensities, and displayed on the CRT screen using known techniques. The vertical and horizontal locations of the cursor are synchronously incremented on a pixel by pixel basis during the scan of a frame buffer line. At the appropriate location, cursor data is multiplexed and/or logically combined with the bit stream of frame buffer data to overlay the cursor characteristics upon the video display data. The cursor data buffer can thereby be relatively small yet overlay a relatively large cursor with minimal manipulation by the computer controlling the video display.

15 Claims, 13 Drawing Sheets

FIG. 3B

| ROW | 31 | 24 | 23 | 16 | 15 | 8 | 7 | 0 |
|---|---|---|---|---|---|---|---|---|
| 0 | 0 | 0 | 0 | 0 | 0 | 0 | 0 | 0 |
| 1 | 0 | 0 | 0 | 0 | 0 | 0 | 0 | 0 |
| 2 | 0 | 0 | 0 | 0 | 0 | 0 | 0 | 0 |
| 3 | 0 | 0 | 0 | 0 | 0 | 0 | 0 | 0 |
| 4 | 0 | 0 | 0 | 0 | 0 | 0 | 0 | 0 |
| 5 | 0 | 0 | 0 | 0 | 0 | 0 | 0 | 0 |
| 6 | 0 | 0 | 0 | 0 | 0 | 0 | 0 | 0 |
| 7 | 0 | 0 | 0 | 0 | 0 | 0 | 0 | 0 |
| 8 | 0 | 0 | 0 | 0 | 0 | 0 | 0 | 0 |
| 9 | 0 | 0 | 0 | 0 | 0 | 0 | 0 | 0 |
| 10 | 0 | 0 | 0 | 0 | 0 | 0 | 0 | 0 |
| 11 | 0 | 0 | 0 | 0 | 0 | 0 | 0 | 0 |
| 12 | 0 | 0 | 0 | 0 | 0 | 0 | 0 | 0 |
| 13 | 0 | 0 | 0 | 0 | 0 | 0 | 0 | 0 |
| 14 | 0 | 0 | 0 | 0 | 0 | 0 | 0 | 0 |
| 15 | 0 | 0 | 0 | 0 | 0 | 0 | 0 | 0 |
| 16 | 0 | 0 | 0 | 0 | 0 | 0 | 0 | 0 |
| ----- | ----- | ----- | ----- | ----- | ----- | ----- | ----- | ----- |
| 31 | 0 | 0 | 0 | 0 | 0 | 0 | 0 | 0 |

BIT MAPPED COLOR CURSOR

BACKGROUND OF THE INVENTION

The present invention relates generally to bit mapped, raster scan, video display systems. More particularly, the invention is directed to a cursor system within such a system that provides a color cursor which may wholly or partially exit the video display from any of the display's four sides.

Techniques for creating and manipulating patterns in a bit mapped video display are commonly known and used in work stations and advanced personal computer systems. A frame buffer memory array is used to store pixel data which is eventually converted into the video display on a CRT screen, or similar screen. The frame buffer memory conventionally includes non-displayed but addressable memory segments. In older display systems accessing data from the frame buffer memory requires considerable time, but with the use of newer, higher speed DRAMs as the frame buffer memory, only fractions of the horizontal display retrace or blank time and the vertical retrace or blank time are used to access video display data. The remainder of the blank times may be used to access the non-displayed but addressable segments of the frame buffer memory and for other purposes. The present invention, in one aspect, efficiently utilizes such available time to create non-displayable, logical pixel spaces located above the top and before the left side of the video display on the screen. These two non-displayable pixel spaces are in addition to the conventional non-displayable logical pixel spaces below the bottom of the display screen and beyond the right side of the display screen, which the cursor may be moved into.

Cursors are shape, color or brightness differences in the representation on the video display which relate the user's activity to information within the work station or computer system. Cursors can be as small as a single pixel in a bit mapped display, or may be comprised of multiple pixels arranged into an informative pattern, such as an arrow, an index finger or a hand. Cursors are most often created by software routines which temporarily move the underlying information off the screen and replace that information with a cursor pattern. Software generated cursors may be quite flexible in their movements on or off of the display screen, but usually degrade in performance when the cursor or screen patterns move or are subject to windowing. Additionally, software generated cursors of some applications, such as Windows by Microsoft Corporation, may occupy up to 30 per cent of a microprocessor's time in order to manipulate the cursor.

Systems which move blocks of data in bit mapped video displays are described in U.S. Pat. No. 4,533,910 and reissued Pat. Re. No. 31,200. According to the first implementation, viewports are defined and inserted into video display frames by changing the frame buffer addresses. In the case of the latter, multiple and elaborate controllers regulate the writing of data to the frame buffer, the scanning of the frame buffer data for presentation on the video display, and the exchange of data exchanged between the system and the host computer. The complexity of both the systems is directed to the formation and manipulation of large windows within graphical systems.

U.S. Pat. No. 4,454,507 is directed to the superposition of vector cursors composed of lines. The cursor generation system therein requires a high speed external memory of significant size, because the complete cursor pattern is stored in the supplemental memory. As a further distinction, the subject matter of the patent is constrained to a direct overly of the cursor images, in contrast to logical combinations of such images with the frame buffer image at the cursor location.

Another patent relating to the generation of cursors in a bit mapped video display is U.S. Pat. No. 4,625,202. The teaching therein is however limited to cursors composed of lines alone, in contrast to two dimensional images even so simple as a "X" or a circle. Accordingly, this cursor generation system is very constrained in potential application.

A further teaching of cursor generation is presented in U.S. Pat. No. 4,668,947 where predefined cursor shapes are stored externally and interjected into the displayed pattern during the scan of the frame buffer by address jumps to a supplemental high speed memory. In some respects, the concepts are analogous to those which underlie the first mentioned pair of U.S. patents. The implementation of the patent has an external high speed memory and also means for tracking both the X and Y axes of the bit mapped display in order to identify the locations where cursor information is to be inserted.

U.S. Pat. Nos. 4,566,000 and 4,354,184 also show cursor systems.

In the context of such prior art, there remains a need for a cursor system which requires very little system CPU processing time in order to manipulate the cursor, which generates a cursor that can be moved off of the display screen from any of the four sides, which generates a cursor unaffected by frame buffer pattern changes such as scrolling or windowing, which can be implemented within the context of the basic frame buffer memory, and which provides logical combinations of cursor and video display pixel information.

SUMMARY OF THE INVENTION

The present invention is directed to a hardware generated multi-color cursor overlay system which uses a small section of the non-displayed frame buffer memory to store cursor control information in two bit mapped information planes. A special raster scan line synchronization architecture creates a non-displayable pixel space adjoining the top and the left side of the video display pixel space into which the generated cursor may be moved in whole or in part. The special raster scan line synchronization architecture inserts a horizontal line pattern of cursor information controlled by the bit mapped planes into the line pattern of its respective video display.

As preferably implemented, a block of non-displayed frame buffer memory is allocated to two planes of bit mapped cursor data. The cursor pattern is written into such block of memory with each line of a first plane starting at an even address within the block and each second plane line starting at the next sequential address within the block. The first address of the block is stored in a cursor map storage register and is loaded into a counter at the beginning of each frame. The first plane line and the second plane line are transferred into respective buffers during the horizontal blanking time preceding the addressing of the associated image line of the frame buffer. During the scan of a display line from the frame buffer, data from the two plane lines are combined to synchronously control the overlaying of the predetermined color cursor line onto the display line of the frame buffer using position counters. A vertical position counter controls the transfer of the appropriate cursor control words from the cursor block, and a horizontal position counter controls the overlaying of cursor pixel data onto the display line from the frame buffer. Both the vertical position counter and the horizontal position counter are provided with offsets which functionally create a vertical non-displayable pixel space and a horizontal non-displayable pixel space into which the cursor pattern may be wholly or partially moved, depending upon the dimensions of the cursor pattern relative to the dimensions of the non-displayable pixel spaces.

The preferred arrangement of the present invention thereby utilizes non-displayed blocks of the frame buffer to store control words that are used to create cursor patterns of multiple colors and diverse shapes and to directly overlay such cursor patterns onto the video display information from the frame buffer without the intervention of the microprocessor and without changing the display information resident in the frame buffer. The implementation also allows logical combinations of cursor patterns with frame buffer display information on a pixel-by-pixel basis. These and other advantages of the present invention will be more fully appreciated upon considering the detailed description which follows.

BRIEF DESCRIPTIONS OF THE DRAWINGS

FIGS. 1A and 1B together form a functional block diagram which illustrates a cursor system in accordance with the present invention.

FIG. 3B illustrates a second bit mapped plane of a bit mapped cursor according to the invention.

Figure 5:
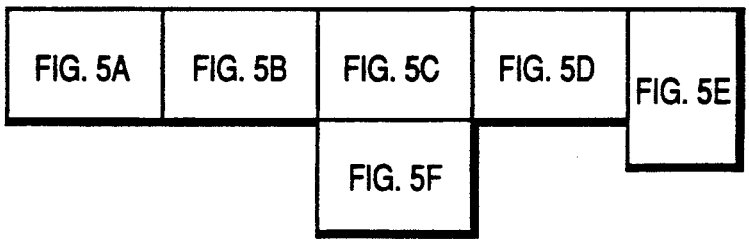

FIGS. 5A–5F when joined as shown in FIG. 5, form a detailed block diagram for the cursor generating system of FIG. 1.

DETAILED DESCRIPTION OF THE INVENTION

Figure 1A:
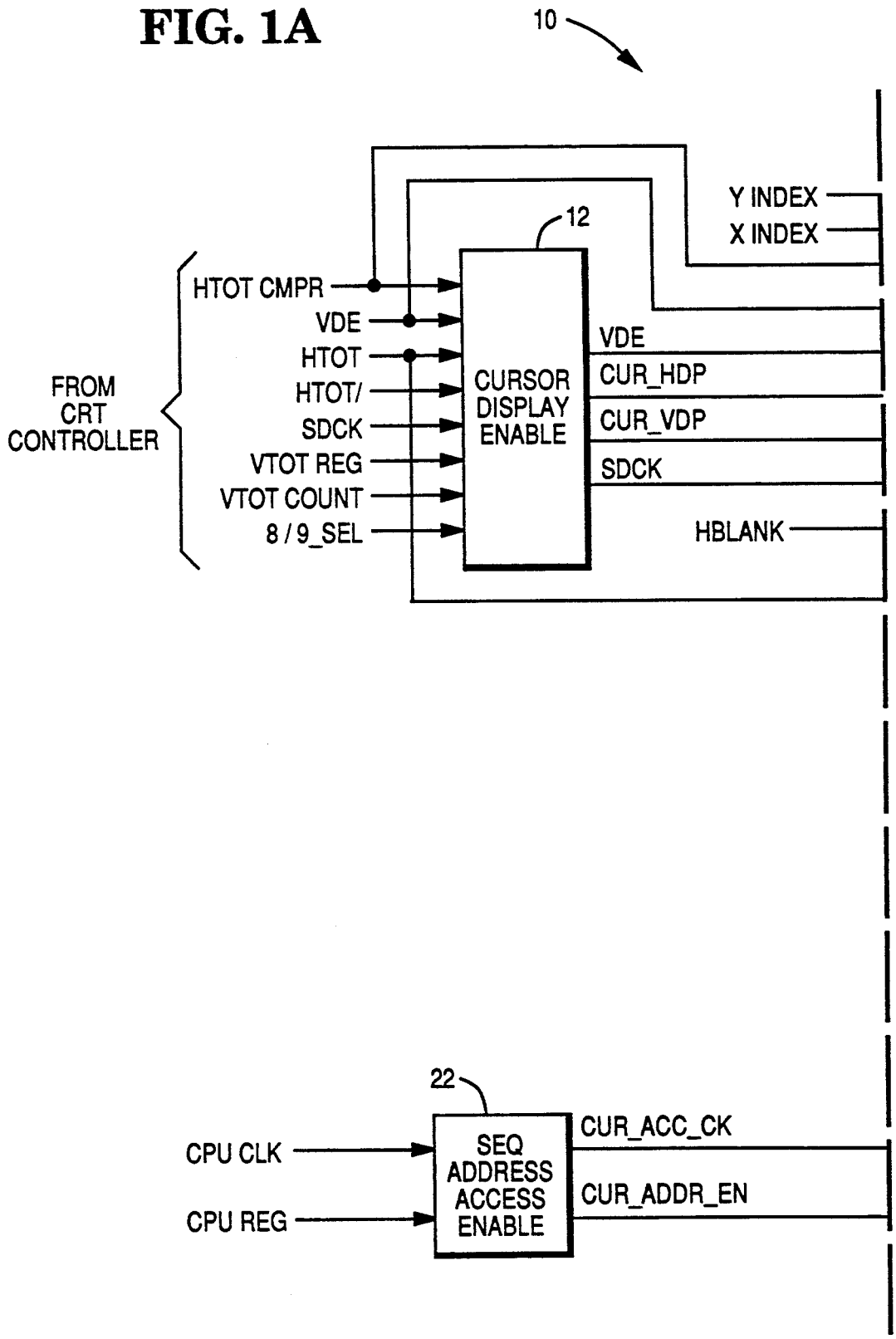
Figure 1B:
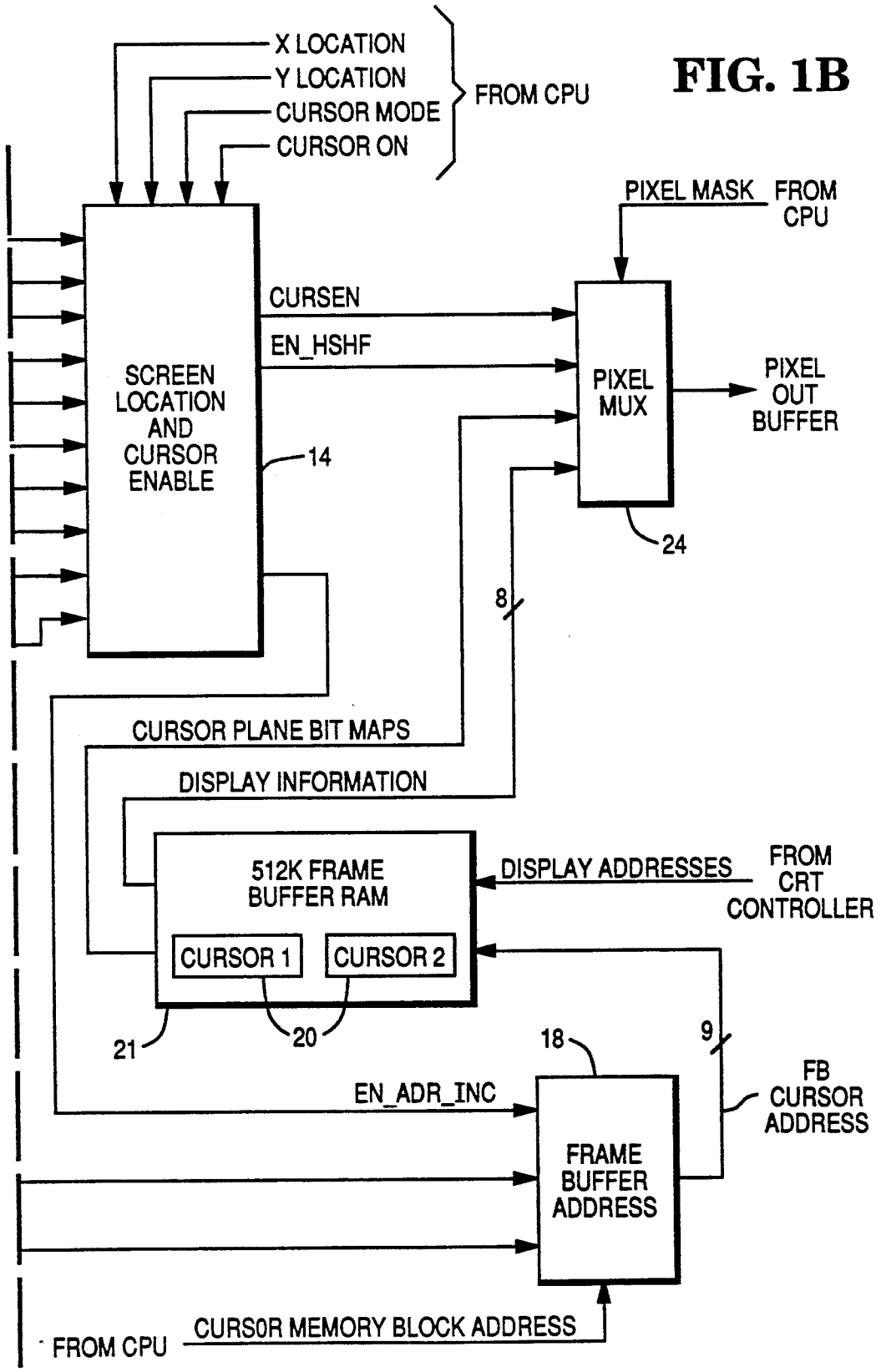

Referring now to FIGS. 1A and 1B of the drawings, there is shown in block diagram form an embodiment of the present invention suitable to generate and control a multiple color cursor for a video display system of otherwise conventional form. The cursor control system depicted in FIG. 1 creates a hardware type cursor overlay using temporary registers which store two 32 bit cursor control words, and vertical and horizontal position counters which synchronize the insertion of cursor overlay pixel information into each corresponding line of display pixel information as such information is accessed from the frame buffer. The cursor control information is also stored in the frame buffer in a non-displayed block of sequential addresses. The cursor pattern information is accessed by reference to its lowest address which is stored by the CPU in a cursor map register. Once the initial address has been accessed, subsequent accesses to subsequent frame buffer addresses are provided by an incrementing counter.

The cursor information is retrieved from the non-displayed section of the frame buffer and written into the two 32 bit cursor control registers during the horizontal blanking time following the raster scan of the previous line. As preferably implemented, the data in the frame buffer for the next video display line is accessed during such horizontal blank time and each pixel of the video display line is sequentially transferred through the cursor control system. As video display pixel information of each raster scan line is transferred therethrough, cursor information under the control of the two 32 bit cursor control registers is synchronously inserted into the video display information by a multiplexing circuit. The inserted information replaces the original video display information. The replacement pixel information may be one of two pre-determined colors or a selectively modified logical combination of a cursor mask and a video display pixel. The beginning and end locations for the insertion of the cursor information within each video display line are determined by a special counter. If there is no cursor information to be inserted into a video display line, then the display information stream is transferred through the cursor control system without modification. The output of the cursor control system is a stream of pixel information that includes any inserted cursor information. This output is latched into an 8 by 1 bit pixel output buffer. From the pixel buffer the pixel information is interpreted and displayed on the display screen in a conventional manner.

The particularized function blocks in FIGS. 1A and 1B can now be referenced to the functional objectives set forth above in the context of the depicted preferred embodiment. As shown in FIGS. 1A and 1B, the cursor control system 10 is connected to and receives control information and timing signals from a conventional CPU (not shown) and a conventional CRT controller (not shown). The cursor control system 10 may be made up of discrete components, or may be integrated into an integrated circuit.

The architecture of the cursor control system 10 includes a Cursor Display Enable circuit 12, a Screen Location and Cursor Enable circuit 14, a Frame Buffer Address circuit 18, Cursor Memory Blocks 20 which are part of a Frame Buffer Memory 21, a Sequential Address Access Enable circuit 22 and a Pixel Multiplexer circuit 24.

The Cursor Display Enable circuit 12 receives numerous timing signals and binary values from its CRT controller, such as the CRT Controller in a VGA graphics controller of an IBM model PS/2. Binary values include a ten bit Vertical Total Register value (VTOT REG) which is programmed by the CRT Controller to be two less than the maximum number of horizontal scan times in a vertical frame including vertical and horizontal blanking times, a ten bit Vertical Total Count value (VTOT CNT) which is a count of horizontal scan times from the beginning of a vertical frame until the end of the frame, i.e. when VTOT CNT=VTOT+2.

The timing signals from the CRT Controller include Horizontal Total (HTOT) and its complement HTOT/, which are pulses generated each time a horizontal scan line is completed; Horizontal Total Compare (HTOT CMPR), which is a five character wide pulse (either 8 or 9 pixel widths per character) generated at the beginning of each horizontal line; Horizontal Blank (HBLANK), which is a pulse that starts and ends with the horizontal blank time of the display; 8/9 Select (8/9 SEL), which is a logic level that indicates whether the horizontal characters are 8 pixels wide or 9 pixels wide; System Dot Clock (SDCK), which provides clock pulses at the rate that dots or pixels are horizontally scanned; and Video Display Enable (VDE), which is a timing pulse that enables the start of the video display on a screen of a CRT or other video display device.

The Cursor Display Enable circuit 12 processes the binary value inputs and the timing inputs to create a non-displayable pixel space that is functionally located before the beginning of each vertical frame and before the beginning of each horizontal scan line in order to provide a logical pixel space above the top edge of the display screen and to the left of the left side of the display screen. These pixel spaces are created to provide spaces into which the pixels of the bit mapped cursor may be moved in whole or in part. These non-displayable pixel spaces allow this cursor system of the present invention to operate over the entire screen display, without any dead corners or edges, just as a software cursor operates, but without the CPU processing overhead time of a software cursor.

The outputs of the Cursor Display Enable circuit 12 are a Cursor Horizontal Display Enable signal (CUR_HDP) and a Cursor Vertical Display Enable signal (CUR_VDP) which respectively adjust the horizontal and vertical display timing of the cursor to enable the cursor to use the additional non-displayable pixel space. The CUR_VDP starts the cursor vertical frame before the start of the image on the display screen by a number of lines that is equal to or one less than a standard vertical height of the cursor pixel block. Similarly, the CUR_HDP horizontal line starts five character widths, i.e. 40 pixels for eight pixel character widths or 45 pixels for nine pixel character widths, which is equal to or one less than a standard horizontal width of the cursor pixel block. These timing adjustments functionally create the non-displayable cursor pixel spaces.

For those cases that it is not desirable for the cursor to be moved entirely off the screen, the top and left non-displayable pixel spaces may be sized such that at least one row or at least one column of the cursor is always left on the screen when the remainder of the cursor has been moved across the top edge or the left side of the display screen.

The Screen Location And Cursor Enable circuit 14 locates and overlays the block of cursor pixels upon the image displayed on the screen. The Screen Location And Cursor Enable circuit 14 receives register information from the CPU, including an X Index, a Y Index, an X Location and a Y Location. The CPU also transfers two control signals, Cursor Mode and Cursor ON, to the Screen Location And Cursor Enable circuit 14. Timing signals HTOT and VDE from the Cursor Display Enable circuit 12, and Horizontal Blank (HBLANK), which is a pulse that starts and ends with the horizontal blank time of the display, are used by the Screen Location And Cursor Enable circuit 14 to synchronize and overlay the cursor with the displayed image on the screen.

The X Index value and the Y Index value are the coordinates of the reference pixel of the cursor within the cursor block. The position of this one reference pixel represents the position of the cursor for selecting items such as icons or radio buttons common to graphical interfaces. Although it would be possible to change these index locations within the cursor pixel block, usually they are predetermined along with the bit map of their respective cursor and do not change thereafter. If another cursor is selected, then possibly the X Index and Y Index values may change.

Figure 4:
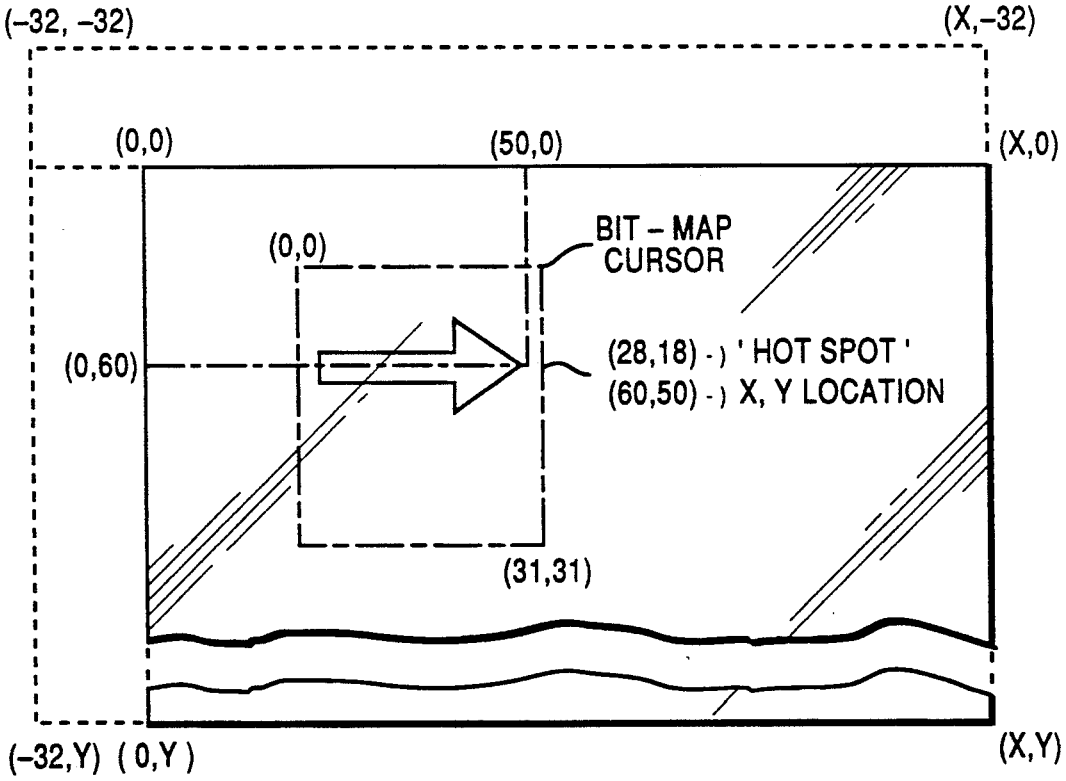
FIG. 4 illustrates a cursor overlaying a video display on a screen, and the location of the non-displayable and the displayable pixel spaces in accordance with the invention.

The X Cursor Location value and the Y Cursor Location value are the coordinates of the cursor with respect to the video display space. The Cursor pixel space includes the video display pixel space of the screen and the non-displayable spaces beyond the top, bottom, and two side boundaries. As shown in FIG. 4, the (0,0) location of the screen display corresponds to <M,N> of the cursor pixel space, where M is the number of non-displayable pixels at the beginning of each horizontal scan line and N is the number of non-displayed lines at the beginning of each vertical frame. In the embodiment of the invention shown in FIG. 4, M and N are both equal to 32, and the cursor is 32 pixels by 32 pixels.

The X Cursor Location and the Y Cursor Location are values maintained by the CPU by monitoring the condition of a pointing device such as a mouse, a joystick, a trackball, cursor keys, et cetera. The CPU updates these locations as the pointing device is actuated, because a later portion of the circuit 14 prevents distortion of the cursor and uncertainty of the location of a distorted cursor, as will be described below.

The Screen Location And Enable circuit 14 uses the X and Y Index values and the X and Y Location values to determine if the cursor is wholly or partially located in the displayed pixel space. If it is wholly in the displayed pixel space, then the cursor is completely displayed, otherwise only that portion of the cursor which overlays some of the video display pixels will be displayed on the screen. The timing signals of the Screen Location And Cursor Enable circuit 14 provide that the adjusted cursor position information is also in synchronism with the underlying pixel data (if any).

Figure 2:
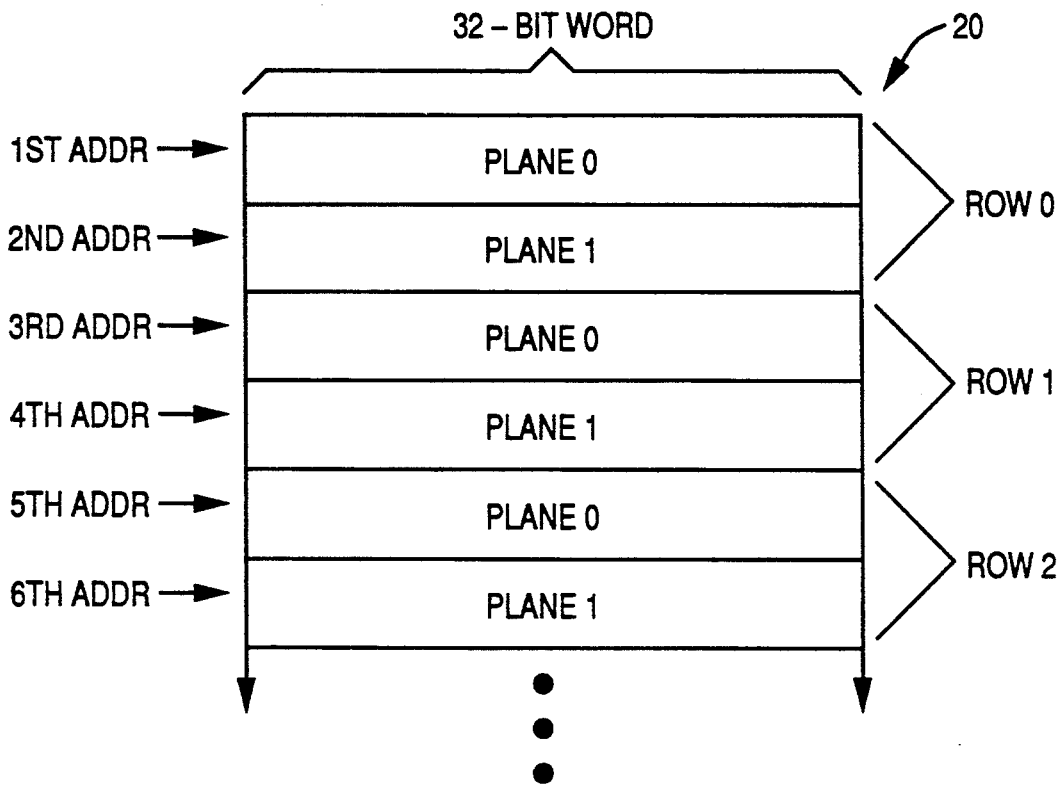
FIG. 2 illustrates an arrangement for storing two planes of bit mapped data by rows within a block of non-displayed addresses of a frame buffer memory.

The Frame Buffer Address circuit 18, the Frame Buffer RAM 21 and the Sequential Address Access Enable circuit 22 operate together to access cursor control information stored in one of a plurality of cursor blocks 20. The cursor control information is stored in two bit mapped planes. Each plane has at least 32 cursor control words and each of the words is 32 bits long. FIG. 2 shows how the data for the cursor control words are interleaved within each cursor block 20. The lowest address of the cursor block 20 contains a first 32 bit word of plane 0. The next sequential address of the cursor block 20 contains a first 32 bit word of plane 1. The CPU stores the lowest address of the currently active cursor block 20 in the Frame Buffer Address circuit 18 (shown in FIG. 1) and the Sequential Address Access Enable circuit 22 (shown in FIG. 1). The Sequential Address Access Enable circuit 22 addresses the first cursor control word directly, and then increments the lowest address to subsequently address the remaining cursor control words. The cursor control words are accessed in pairs, one control word from each bit mapped plane. Together, each pair of control words controls the characteristics for one row or line of the cursor. Thus, by sequentially addressing pairs of cursor control words from the cursor block 20 the entire cursor pattern is written upon the video display line by line.

Figure 3A:
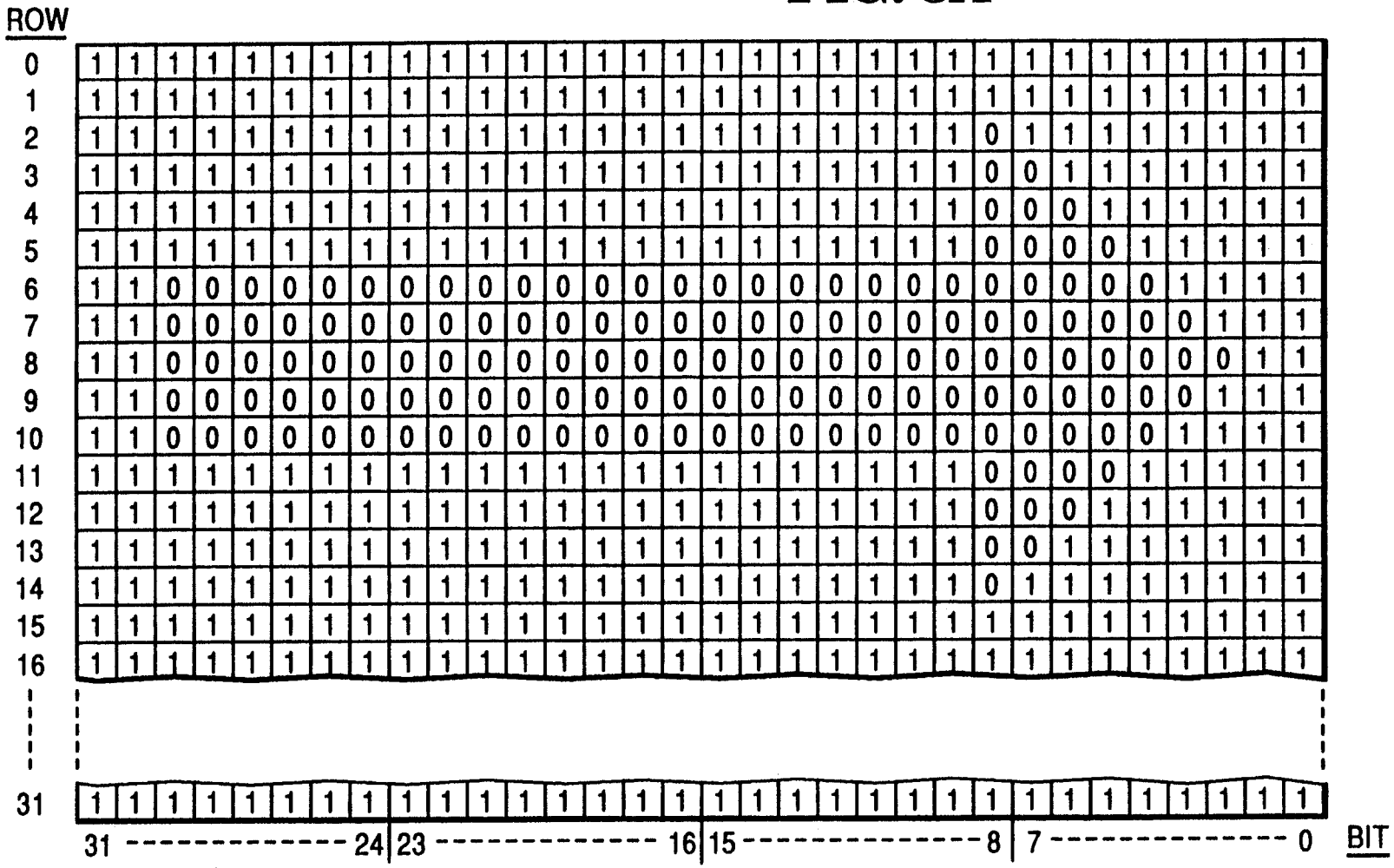
FIG. 3A illustrates a first bit mapped plane of a bit mapped cursor according to the invention.

FIGS. 3A and 3B represent a bit mapped plane 0 and a bit mapped plane 1 of a right pointing arrow pattern.

The arrow includes a foreground color outlined by a background color which is further outlined by an inversion of the underlying display pixel The remainder of the 32×32 pixel cursor is "transparent" which means that the overlying cursor pixels are the same as the underlying display pixels.

Figure 3C:
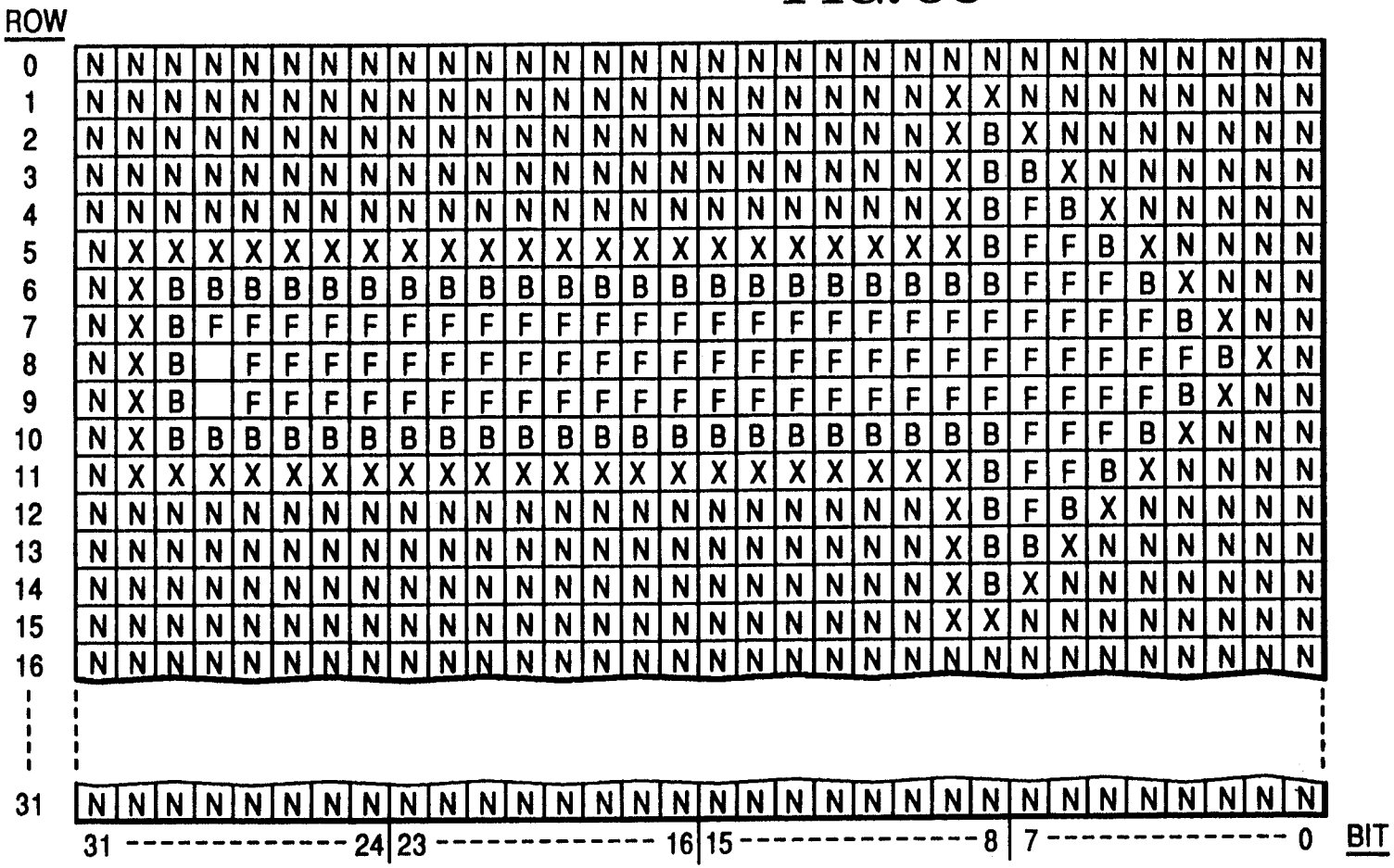
FIG. 3C illustrates a combination of the bit mapped planes of FIGS. 3A and 3B and the cursor that is generated thereby.

The combined cursor pixel control map is shown in FIG. 3C. The letter F denotes that this cursor pixel will be decoded to provide a pre-determined foreground color, B denotes that the pixel will be decoded to provide a pre-determined background color, X denotes that the pixel will be decoded to provide a logical inversion of the underlying display color, and N denotes that the underlying pixel will be allowed to "show through." FIG. 4 shows how the arrow cursor might appear on a display screen. The edges of the 32 by 32 pixel cursor are shown in dashed lines for reference only since in the case of FIGS. 3A-3C these edges would be invisible.

Referring back to FIG. 1, the Frame Buffer RAM 21 separately stores both cursor information and the display information for the screen (shown in FIG. 4). The first row (Row 0) of bit plane 0 and bit plane 1 are loaded from cursor block 20 within RAM 21 into respective registers in Pixel Mux 24. The display information is arranged by horizontal scan lines that are accessed a line at a time by control signals from the CRT controller (not shown) in a standard way. The attributes, e.g. color and intensity of the pixels, are controlled by eight bits of parallel pixel data transferred pixel-by-pixel through the Pixel Mux 24. As the pixel information of each scan line is transferred through the Pixel Mux 24, the Cursor Display Enable circuit 12 and the Screen Location And Cursor Enable circuit 14 monitor the destination of each of the display pixels. When a location within a scan line is found which corresponds to a location where a line of cursor pixels is to overlay some of the display pixels, then the corresponding row of cursor information controls the synchronous insertion or logical combination of cursor information into the stream of pixel information for that scan line. The resulting scan line is transferred out of the Pixel Mux 24 and is stored briefly in a Pixel Out Buffer (shown in FIG. 5F). From the Pixel Out Buffer, this information is subsequently transferred in a standard manner for video display on a screen.

Figure 5A:
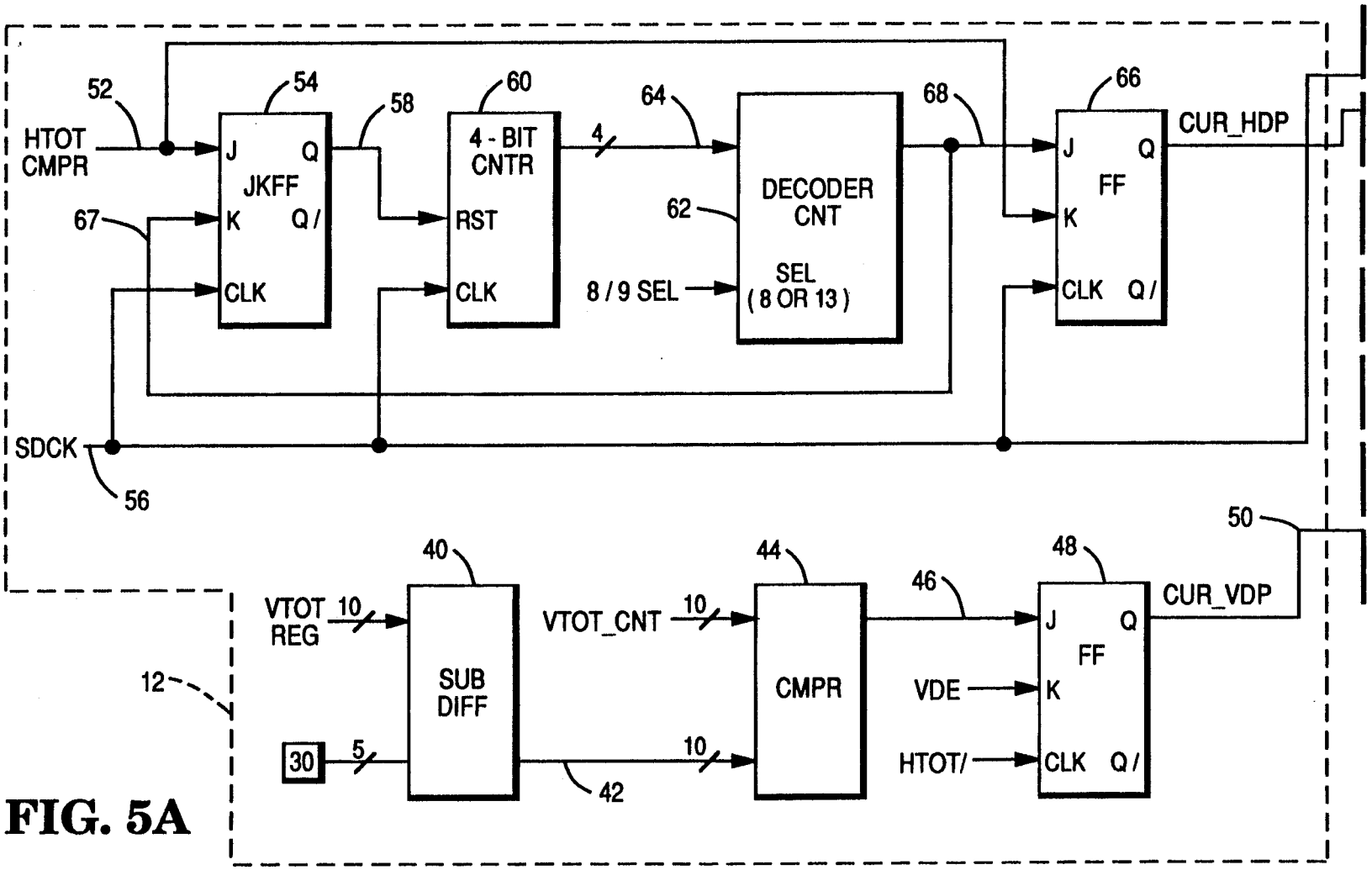

Referring now to FIG. 5A, a preferred embodiment of the Cursor Display Enable circuit 12 will be described. The VTOT Register value, expressed as a 10 bit binary number, is transferred into a subtracter 40 which subtracts a fixed value of binary 11110 (30 base ten) from the VTOT Register value (which is already two less than the total number of horizontal scan lines in a corresponding video display frame). The resulting difference is used to provide a non-displayable space of 32 horizontal lines above the first horizontal scan line displayed. This non-displayable space provides a logical space that the cursor may be move wholly or partially moved into as described above.

The difference output of the subtracter 40 is a 10 bit binary number that represents the point in the vertical scan, as represented by a VTOT_CNT value, at which the vertical frame for the cursor and its expanded cursor pixel space begins. This difference output is connected via line 42 to a comparator 44. When the value of (VTOT REG −32) equals VTOT_CNT, comparator 44 outputs a logic HI via line 46 to flip-flop 48. The logic HI on line 46 causes the flip-flop 48 to set its non-inverted output Q to logic HI. This output is the cursor vertical display enable, which is outputted via line 50 to the Screen Location And Cursor Enable 14 (shown in FIG. 5B). The cursor vertical display enable signal serves as the vertical reference point from which vertical positions are determined. The input signals VDE and HTOT/ from the CRT Controller serve to reset the flip-flop 48 in preparation for the start of the next cursor vertical frame.

The horizontal portion of the Cursor Display Enable circuit 12 is a little more complex than the vertical portion just described. The CRT controller (not shown) outputs a HTOT CMPR pulse that is five character times long at the start of displayed line. The five character times correspond to 40 or 45 horizontal pixel times before the start of each line, depending upon the selection of eight pixel or nine pixel characters. To adjust the start of the cursor horizontal pixel scan for a 32 pixel cursor, a 32 bit horizontal pixel space before the start of each horizontal video display scan is required. To accomplish this, the HTOT CMPR signal is used to indicate the start of a cursor horizontal pixel line, and the system dot clock (SDCK) pulses, i.e. the pixel clock, is used to determine the start of the display horizontal pixel line 32 pixels after the start of the cursor line.

The horizontal cursor display enable circuit has the HTOT CMPR signal connected via line 52 to a J input of a JK flip-flop 54 and to a K input of JK flip-flop 66. Thus connected, the HTOT CMPR signal sets flip-flop 54 from a reset condition, and insures that flip-flop 66 is reset. When flip-flop 54 is set, its non-inverted output Q goes to a logic HI. This logic HI is connected via line 58 to a reset input of a four bit counter 60. The four bit counter 60 is reset to 0000 by a logic LO on its reset input, so the setting of the flip-flop 54 enables the 4-bit counter 60 to begin counting up from 0000. The SDCK signal is connected via conductor 56 to a clock input of flip-flop 54 and serves as an alternate source of setting and resetting the flip-flop 54 in some conditions.

The SDCK pulses are also connected via conductor 56 to a clock input of four bit counter 60, and upon being reset and enabled by the flip-flop 54, the counter 60 begins to count SDCK pixel times. The counter 60 has a four bit output (actually only three are needed since the second bit is a "don't care") connected to a Decoder 62 via conductors 64. The Decoder 62 is selectable to output a logic HI when a binary eight (1000) is impressed upon its 4-bit input by the counter 60, or when a binary 13 (1101) is impressed thereupon. The 8/9 select signal may be provided from the CRT controller, or alternatively from a control register set by the CPU. The output of the decoder 62 becomes asserted either (40−8) pixels before a display scan line with eight pixel wide characters, or (45−13) pixels before a display scan line with nine pixel wide characters. In either case, a time delay for a 32 pixel, non-displayable cursor pixel space is decoded. The output of the decoder 62 is connected via line 67 to the K input of JK flip-flop 54 and via line 68 to the JK flip flop 66. Flip-flop 54 is reset and flip-flop 66 is set when the decoder 62 reaches its selected count of 8 or 13. Resetting the JK flip-flop 54 resets the counter 60. The JK flip-flop 66 when set by decoder 62 outputs a horizontal cursor enable signal (CUR_HDP) on line 69 until the next HTOT CMPR resets flip-flop 66 at the start of the next horizontal scan time.

Figure 5B:
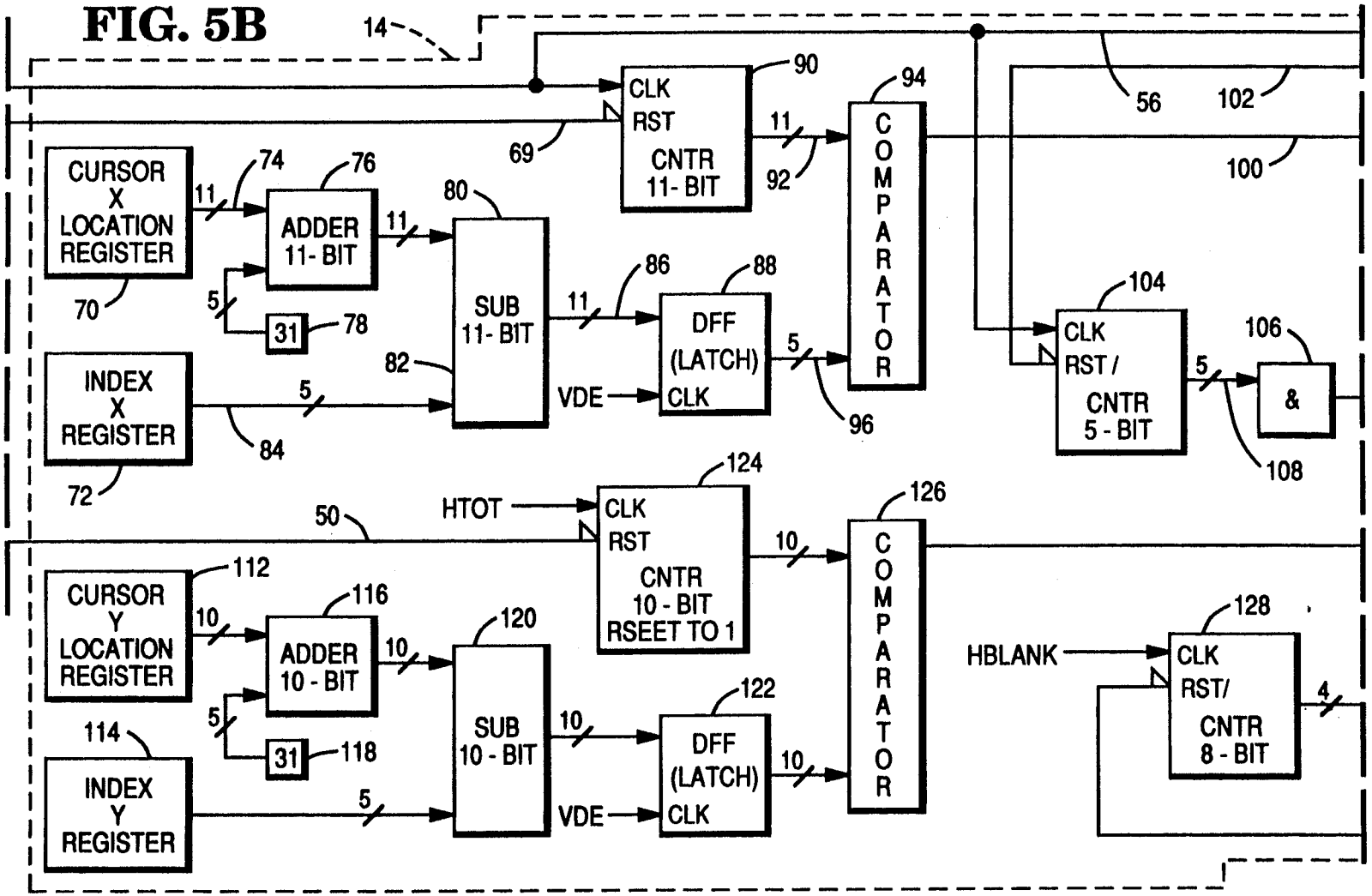

Referring now to FIG. 5B, a preferred embodiment of the Screen Location And Cursor Enable circuit 14 will be described. The Screen Location And Cursor Enable circuit 14 provides an X location function and a Y location function to locate the cursor on the screen.

The CPU (not shown) writes an 11 bit control word into Cursor X Location Register 70 in response to location information from a pointing device such as a mouse, a joystick, a stylus, etc. (not shown) in a straightforward manner. This X location is the horizontal screen position of the cursor reference pixel with respect to the left side of the screen. The writing of this control word may take place at any time, because the latch 88 prevents the propagation of changes affecting the display screen of the cursor until vertical blanking time, as previously mentioned.

The CPU (not shown) also writes into an Index X Register 72 a five bit binary control word. This control word provides the horizontal displacement of the reference pixel from the left side of the cursor, i.e. the upper left hand corner of the cursor is (0,0). For example, the cursor shown in FIG. 3C has its reference pixel located at the tip of the arrow which is 28 pixels from the left side of the cursor. Since the preferred size of the cursor is 32×32 pixels, although those skilled in the art will recognize that this design could be easily modified to provide cursors other than 32×32 , the Index X value cannot exceed 32. For this reason, the Index X Register 72 must only be five bits wide.

The Cursor X Location Register 70 is connected via multiple conductor line 74 to an input of an Adder 76. The Adder 76 is connected at its second input to a device 78 that provides a binary 31 (11111) five bit output. Thus, the output of the Adder 76 is the screen location of the reference pixel added with 11111 binary. This addition adjusts the screen X-location to the cursor pixel space location. The output of the Adder 76 is connected via multiple conductor line 80 to an input of Subtracter 82. The second input to the Subtracter 82 is connected via multiple conductor line 84 to the Index X Register 72. By subtracting the Index X value, the Subtracter 82 adjusts the start of the 32×32 pixel cursor. The Subtracter 82 reduces the X location in the cursor pixel space by the horizontal displacement of the reference pixel within the 32×32 cursor. The output of the Subtracter 82 is connected via a multiple conductor line 86 to an eleven bit wide data input of eleven bit wide D flip-flop 88. The resulting output of the Subtracter 82 represents a left most X location of the first displayable cursor pixel. The enabling signal for the first displayed pixel location of the cursor is latched into the D flip-flop 88 by VDE at the beginning of the video display. This X location remains unchanged at least until the next vertical frame and the next VDE signal. In this manner the X position of the cursor cannot change during any one vertical frame. This prevents horizontal distortion and ambiguity which might otherwise be caused by movement of the pointing device.

A counter 90 has its reset input connected via line 69 to the output of flip-flop 66 (shown in FIG. 5A) and receives the CUR_HDP signal thereby. The CUR_HDP signal enables the counter 90 to start counting at the beginning of the cursor pixel space 32 horizontal pixels before the start of the first screen displayed pixel in the corresponding horizontal line. A clock input of the counter 90 is connected to the line 56 and receives the SDCK signal thereby. The output of the counter 90 which is the X location within the cursor pixel space is connected via a multiple conductor line 92 to a Comparator 94 for further processing.

The Comparator 94 has its second input connected via multiple conductor line 96 to the eleven bit flip-flop 88. Thus connected, the Comparator 94 compares the horizontal location of the left most pixel of the cursor from the flip-flop 88 with the horizontal scan location within the cursor pixel space, i.e. the value in pixels equal to (horizontal screen position+32). When the signals on the two inputs are equal, an output of Comparator 94 goes to logic HI indicating that the horizontal scan has attained the location of the left most edge of the cursor.

Figure 5C:
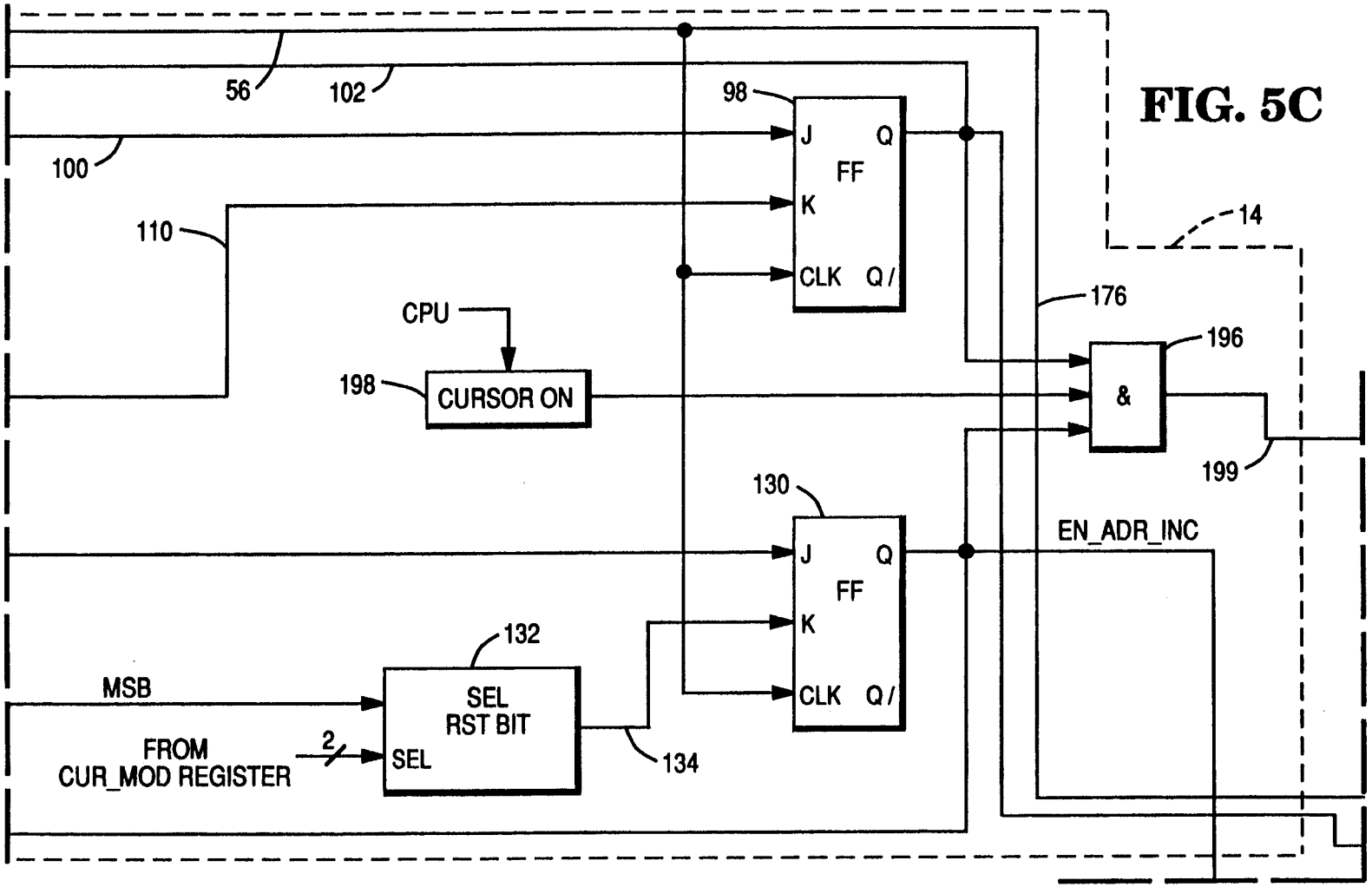

Referring now to FIGS. 5B and 5C, a JK flip-flop 98 is connected via a line 100 to the output of Comparator 94, and is set when the comparator output goes to logic HI. When flip-flop 98 is set, the non-inverted output Q goes to logic HI. This output is connected back via line 102 to a reset input of a five bit counter 104. The five bit counter 104 is reset to 00000 by the logic LO to logic HI transition of the signal on its input. After being reset, the five bit counter 104 is enabled to count. A clock (CLK) input of the five bit counter 104 is connected to SDCK, i.e. the pixel clock, via line 56. When the five bit counter has counted up to 11111, i.e. when it has counted 32 pixel clocks from being reset, a five input AND gate 106 connected via multiple conductor line 108 to the output of the five bit counter 104 decodes the count and inputs a logic HI via line 110 to a K input of flip-flop 98. This logic HI resets the flip-flop 98 after 32 pixel clock times. The 32 pixel times are equal to the length of time required to process the 32 bit long cursor line that corresponds to the portion of the video display line that would be shown on the screen if there were no overlying cursor pixels. Thus, for each scan line, the X-location circuitry locates the start of the cursor in either the non-displayable pixel space, or in the displayable portion of a video display scan line and counts 32 more clocks to locate the end of the cursor line that corresponds to the current video display scan line.

The Y location circuit, including Cursor Y Location Register 112, Index Y Register 114, Adder 116, predetermined value device 118, Subtracter 120, D flip-flop 122, counter 124 and comparator 126 works essentially the same as the X location circuit described previously. The differences being that since there are fewer lines per frame than there are pixels per line, only a 10 bit Adder 116, a 10 bit Subtracter 120, a 10 bit flip-flop 122, a 10 bit Counter 124, and a 10 bit Comparator 126 are required. Further, the Counter 124 is reset by the CUR_VDP signal and is clocked by the HTOT pulses that occur when the horizontal scan has attained the end of its scan line, rather than being clocked by SDCK pulses as the X location circuit is. Line Counter 128 also operates somewhat differently than cursor pixel counter 104 in that the Line Counter 128 is reset to 00000001 when it is reset.

The Comparator 126, when its input have equivalent values impressed thereon, outputs a logic HI to JK flip-flop 130 which puts the flip-flop 130 in a set condition. The non-inverted output Q of flip-flop 130 is connected back to the Line Counter 128, which is analogous to the connection of the X location flip-flop 98. When the Q output of flip-flop 130 transitions from logic LO to logic HI, counter 128 is reset to 00000001. The reset count of 00000001 represents the first line of the cursor. From this first line, the counter 128 counts the HBLANK pulses, one of which occurs at the end of each non-displayable and each displayable scan line, up to a count value of 00010000 (16), 00100000 (32), 01000000 (64), or 10000000 (128), which are the selectable vertical lengths of cursors. The end-of-cursor condition is decoded by Select Reset Bit decoder 132 which selectably decodes one of the four most significant bits of the counter 128. The decoding selection is provided by a two bit select signal from a cursor mode register (not shown) that is maintained by the CPU (not shown). When the selected end-of-cursor condition is decoded, the Select Reset Bit decoder 132 outputs a logic HI to a K input to flip-flop 130 via line 134. The logic HI on its K input resets the flip-flop 130, which indicates an end-of-cursor in the vertical direction, just as the resetting of flip-flop 98 indicates an end-of-cursor in the horizontal direction.

Figure 5D:
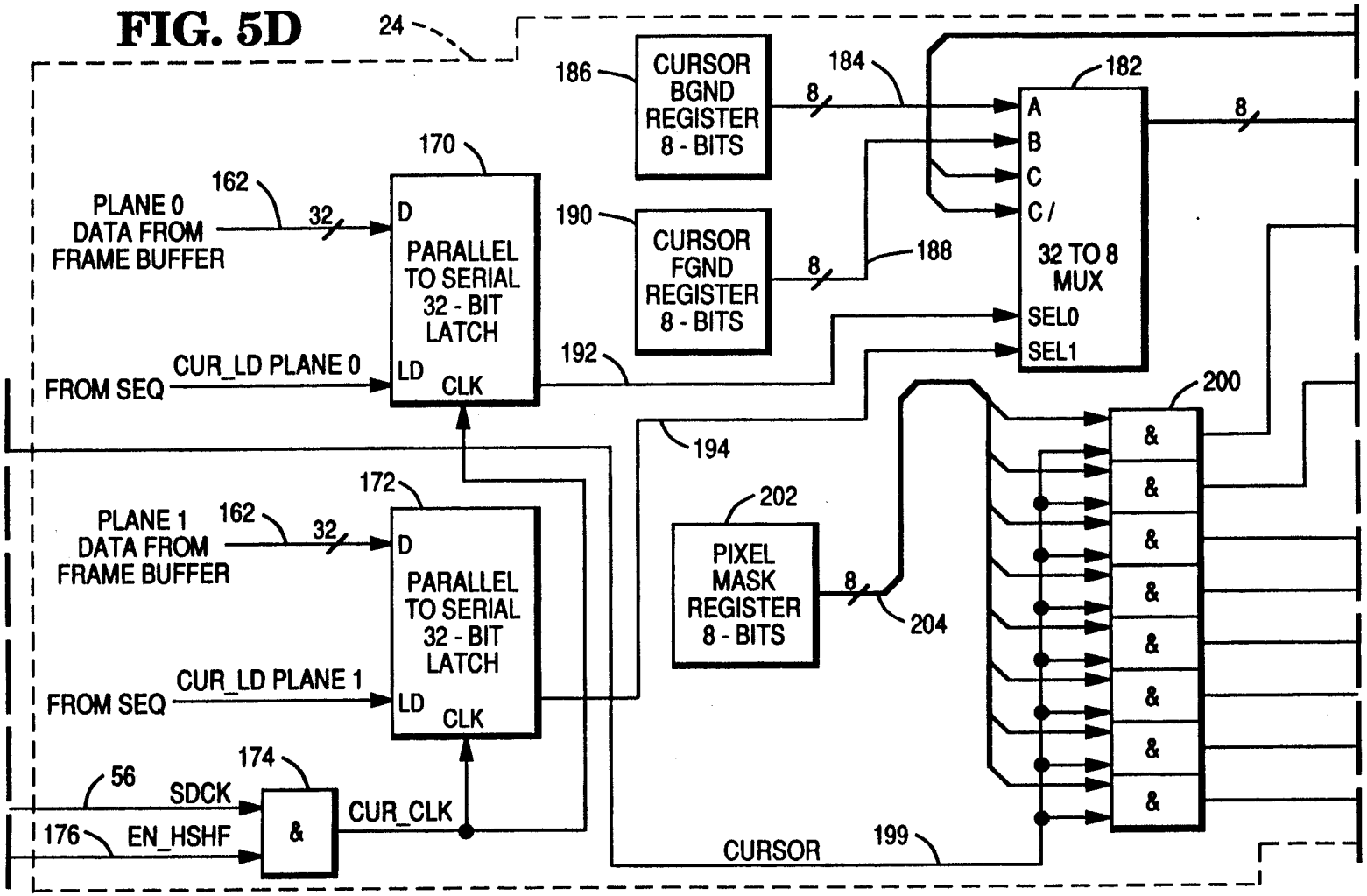
Figure 5E:
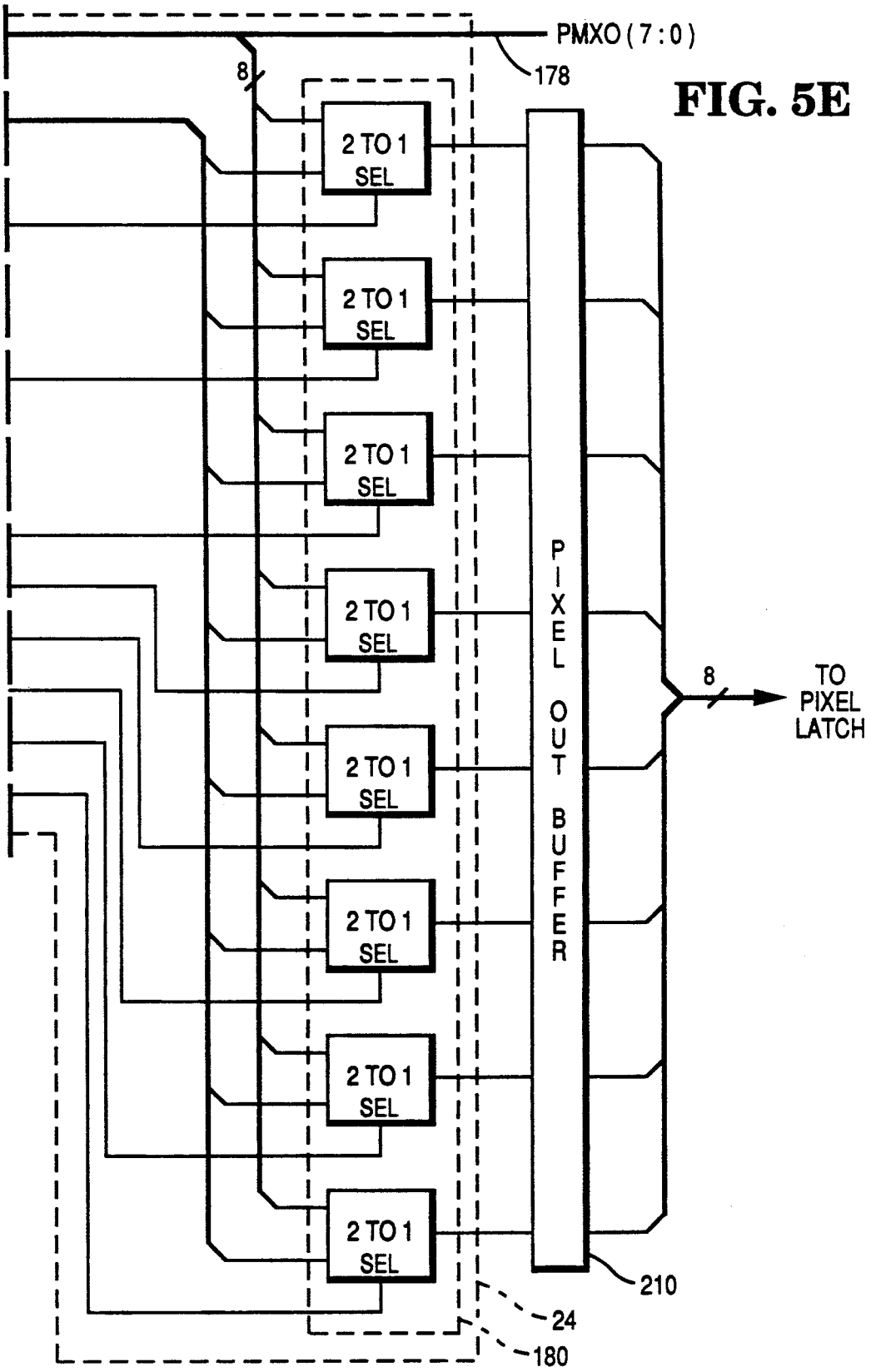
Figure 5F:
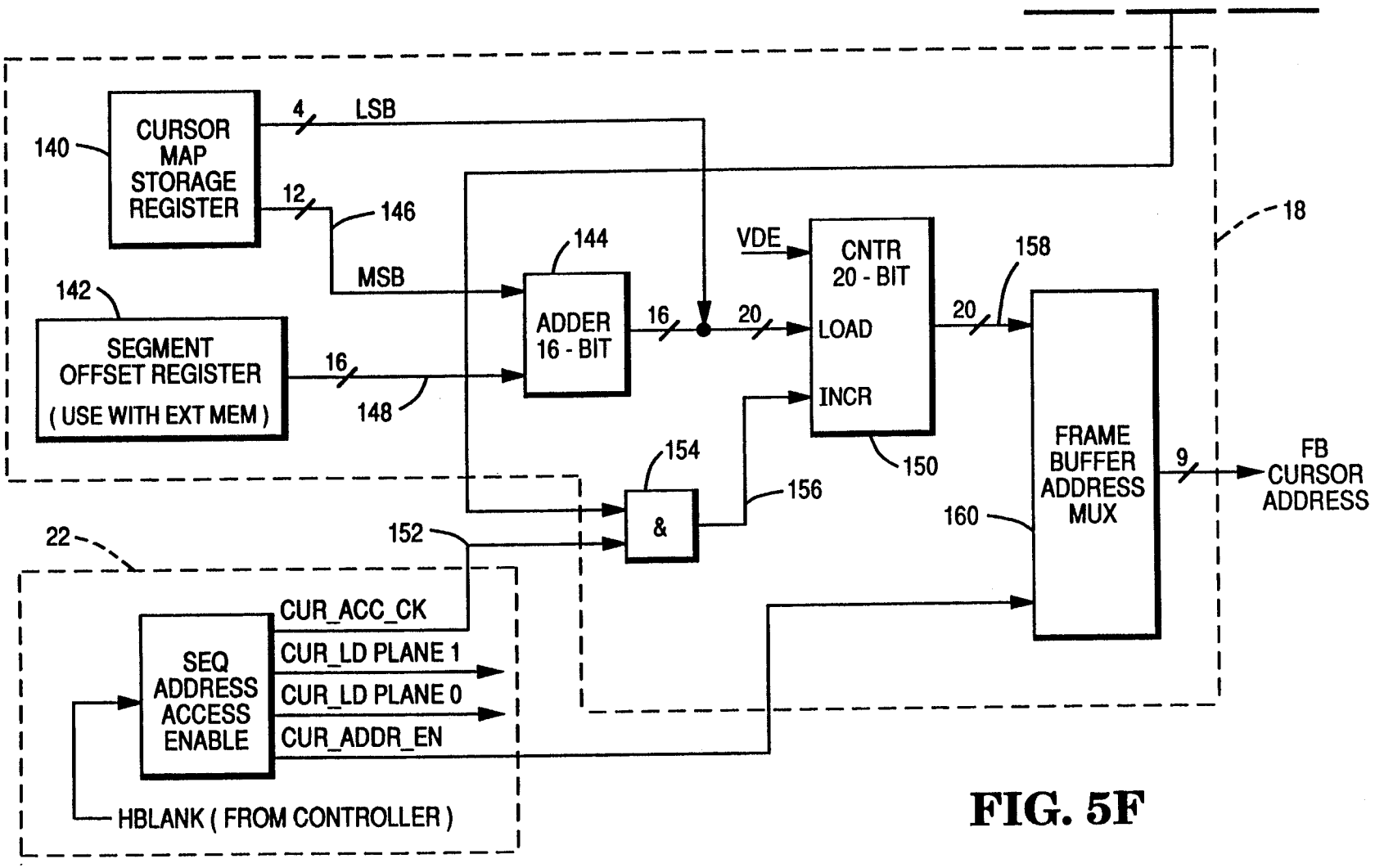

Referring now to FIG. 5F, the Frame Buffer Address circuit 18 and the Sequential Address Access Enable circuit 22 will be described. The Frame Buffer Address circuit 18 and the Sequential Address Access Enable circuit 22 oversee the retrieval of each cursor block 20, including the two bit mapped planes stored therein.

The Frame Buffer Address circuit 18 has two registers that are written to by the CPU with address information that selects the first address in memory of the currently selected cursor and its two bit mapped planes. A Cursor Map Storage Register 140 is a 16 bit register that is the normal register for storing the address of the first and lowest address of the first 32 bit control word of the first bit mapped cursor plane stored in the frame buffer RAM 21 (shown in FIG. 1). For larger than normal sizes of the RAM 21, the 32 bit control words may be accessed using offset addressing techniques. For offset addressing, a memory offset consisting of the 16 most significant bits of a 20 bit address may be WRITTEN by the CPU into Segment Offset Register 142. An Adder 144 receives the 12 most significant bits of the 16 bit cursor address from Cursor Map Storage Register 140 via multiple conductor line 146 as one input, and the 16 most significant bits of a 20 bit offset from Segment Offset Register 142 via multiple conductor line as another input. The 12 bits from the Cursor Map Storage Register 140 are added to the 12 least significant bits from the Segment Offset Register 142 by the Adder 144 and the resulting 16 sum bits are concatenated with the 4 least significant bits from the Cursor Map Storage Register 140 to provide a 20 bit lowest address to an incrementing counter 150 as its preset count value. If offset addressing of extended memory addresses is not used, then the 16 bit input from the Segment Offset Register 142 consists of binary zeroes.

The Sequential Address Access Enable circuit 22 provides for the accessing and loading of a line of bit mapped data from each cursor plane. The loading takes place during the horizontal blanking, thus the horizontal blanking signal HBLANK from the CRT Controller (not shown) is used as its timing reference. During each horizontal blank time, the Sequential Address Access Enable circuit 22 derives Cursor Access Clock control signals, CUR_ACC_CK from the HBLANK signal. The CUR_ACC_CK signals are outputted from the Sequential Address Access Enable circuit 22 via line 152 to one input of AND gate 154. A second input to the AND gate 154 is an Enable Address Incrementing signal (EN_ADR_INC), which is the signal provided by the non-inverted output of JK flip-flop 130. The EN_ADR_INC signal enables the CUR_ACC_CK pulses to drive an increment input of Incrementing Counter 150 via line 156. The CUR_ACC_CK causes the incrementing counter to increment twice to address two bit mapped control words that correspond to two lines of bit mapped cursor control planes.

The addresses from the Incrementing Counter 150 are connected via multiple conductor line 158 to a Frame Buffer Address Multiplexer 160, which temporarily stores each address so that it may be divided into a 9 bit row address and a 9 bit column address that are multiplexed in a known way to provide row and column inputs to the Frame Buffer RAM 21 (shown in FIG. 1). For each row and column address provided to the Frame Buffer RAM 21, a 32 bit bit mapped cursor control word is outputted via a 32 bit data bus 162 to either a Parallel to Serial Plane 0 Latch 170 or to a Parallel to Serial Plane 1 Latch 172, see FIG. 5D. Parallel loading into the Latches 170 and 172 is controlled by cursor load enabling signals CUR_LD_PLANE 0 AND CUR_LD_PLANE 1 respectively, which are derived from the HBLANK signal by the Sequential Address Access Enable circuit 22 (shown in FIG. 5F).

Referring now to FIGS. 5C and 5D, the operation of the Pixel Multiplexer 24 will be described. Once a 32 bit control word from each of the bit mapped planes have been loaded from their respective frame buffer memory addresses (shown in FIG. 2) into their respective Plane 0 Latch 170 and the Plane 1 Latch 172, the information in these two planes may be used to control the overlaying of the cursor upon the video display.

AND gate 174 has a first input connected to SDCK via line 56 and a second input connected via line 176 to the non-inverted output of JK flip-flop 98. The output of JK flip-flop 98 is used as an enable horizontal scan (EN_HS) which enables AND gate 174 to provide a cursor clock (CUR_CLK) signal as an output. The CUR_CLK signal is only provided to the Latches 170 and 172 when the portion of a video display to be overlaid by the cursor is shifted through the 32 to 8 Multiplexer 182. The CUR_CLK signal, when enabled, clocks out a control bit from plane 0 and a control bit from plane 1 which are used to control Multiplexer 182 to select the type of pixel to be displayed at that X position on the display screen, as will be explained below.

Video display pixel information to ultimately drive the display screen is received by the Pixel Multiplexer 24 via multiple conductor line 178, each pixel having an 8-bit parallel word on the line 178 that controls its color and intensity characteristics. The video display pixel information on line 178 is connected to first inputs of an 8-bit wide 2 to 1 Multiplexer 180 and also to a 32 to 8 Multiplexer 182. Each of the eight sections of the 2 to 1 Multiplexer 180 may select the non-processed video display information from line 178 when its select bit is asserted, or the data that has been processed by the cursor control multiplexer 182 when its 2 to 1 Multiplexer select bit is not asserted.

The 32 to 8 Multiplexer 182 is arranged to have four 8-bit data inputs and one 8-bit data output. The 32 to 8 Multiplexer 182 also has two select inputs which select one of the four 8-bit data inputs to connect to its output. The first 8-bit input is connected via multiple conductor line 184 to a Cursor Background Register 186. This register 186 has an eight bit control word written into it which corresponds to the pre-determined background color for the bit mapped cursor. The second 8-bit input is connected via multiple conductor line 188 to a Cursor Foreground Register 190. This register 190 has a second eight bit control word written into it which corresponds to the pre-determined foreground color for the bit mapped cursor. The third 8-bit input is connected to the line 178 such that the information on this input is the same as the underlying image information, and thus the output is the underlying image information, i.e. this is a "transparent" portion of the cursor. The fourth 8-bit input is an inverting input; that is, each of the 8 bits is inverted to provide a logic HI output if its input was a logic LO, and a logic LO output if its input was a logic HI. This fourth 8-bit input is also connected to the line 178, so the output of the multiplexer 182 is 8-bit parallel video display information that has been bit-by-bit inverted. The two select bits, SEL0 and SEL1 provide four possible combinations to select one of the four inputs of multiplexer 182. SEL0 is connected via line 192 to the serial bit output of Plane 0 Latch 170 and SEL1 is connected via line 194 to the serial bit output of Plane 1 Latch 172.

Thus connected, the two 32 bit cursor control words associated with the current video display scan line are combined by the 32 to 8 Multiplexer to multiplex a cursor pixel control word that is a background color control word, a foreground color control word, a "transparent" color control word, or is an inverted pixel color control word, whenever the position of the cursor is at least partially in the displayed pixel space. Some of this operation is still valid and still occurs when the cursor is in the non-displayable pixel space; however, the foreground/background pixels have no "on screen" position. Furthermore, for non-displayable pixels the video display pixels for the current line will not have started yet, and therefore they cannot be overlaid or logically changed.

An AND gate 196 has a first input connected to the output of the horizontal cursor enable JK flip-flop 98, a second input connected to the output of the vertical cursor enable JK flip-flop 130. A third input is connected to a Cursor On Register 198. All three inputs of AND gate 196 must be logic HI in order to enable the insertion of cursor data. As mentioned above, the outputs of flip-flops 98 and 130 go to logic HIs when the X-location and the Y-location of the cursor block have been respectively attained by the video display. The Cursor On Register, however, is initialized in the logic LO condition and remains there unless the CPU activates the hardware cursor by writing a logic HI into the Cursor On Register 198. When all these conditions are met, a Cursor Enable signal is outputted on line 199.

An arrangement of eight 2-input AND gates 200, each has one of its inputs connected to the Cursor Enable signal on line 199. Each of the second inputs of the AND gates 200 is connected to a respective output of an eight bit register 202 by a multiple conductor line 204. The register 202 is load by the CPU with a predetermined pixel mask. Each of the eight outputs of the AND gates 200 is connected to a respective select input of the eight 2 to 1 Multiplexer 180 (shown in FIG. 5E). Thus, the cursor eight bit pixel control word inserted by the 32 to 8 multiplexer 182 and the cursor circuits, may still be bypassed in favor of the underlying video display information on a bit-by-bit basis by operation of the pixel mask in register 202. Changing cursor control bits on a bit-by-bit basis can have some undesirable results, so the pixel mask is used to limit the range of colors and intensities that are possible for the case of a logical inversion of a pixel.

Referring now to FIG. 5E, the pixel information from the output of the eight section 2 to 1 Multiplexer 180 is connected to a pixel output buffer 210 where it is temporarily stored for final processing and transmittal to the display screen, such as a conventional VGA display screen. The hardware cursor that is displayed either wholly or partially on the display screen may be moved over any part of the underlying video display, or it may be moved entirely off of the display screen from any of the four sides of the screen. And, since it is a hardware implemented, rather than a software implemented cursor, the CPU processing time requirements are low.

While the invention has been particularly illustrated and described with reference to a preferred embodiment thereof, it will be understood by those skilled in the art that various changes in form, details, and applications may be made therein. It is accordingly intended that the appended claims shall cover all such changes in form, details and applications that do not depart from the true spirit and scope of the invention.

We claim:

1. A system for displaying a bit mapped cursor within an array of display pixels, said bit mapped cursor having a plurality of pixels arranged in a rectangular block and one of said plurality of pixels is pre-determined to be a reference pixel, comprising:

means for providing a vertical non-displayed pixel space logically located above and adjoining said array of display pixels;

said vertical non-displayed pixel space means includes means for providing a cursor vertical frame that begins a period of time that is equivalent to a period of at least one horizontal scan line before a vertical frame of said display pixels begins;

means for providing a horizontal non-displayed pixel space logically located before and adjoining said array of display pixels;

said horizontal non-displayed pixel space means includes means for providing a cursor horizontal frame that begins a period of time that is equivalent to a period to horizontally scan at least one pixel before a horizontal scan line of said display pixels begins;

means for storing a pre-determined vertical location that is located within said array of display pixels as a horizontal location of said reference pixel;

means responsive to said vertical location storage means and said horizontal location storage means for determining those cursor pixels of said plurality of pixels that will be displayed because they are overlying said array of display pixels and those cursor pixels that will not be displayed because they are located in said non-displayed pixel spaces; and means for controlling the display of said array of display pixels if there are no overlying cursor pixels, and the display of cursor pixels if there are overlying cursor pixels.

2. The system of claim 1, wherein:

said vertical non-displayed pixel space means provides a vertical pixel space having a vertical extend substantially equal in extend to a vertical size of said plurality of pixels; and said horizontal non-displayed pixel space means provides a horizontal pixel space having a horizontal extent substantially equal in extent to a horizontal size of said plurality of pixels;

whereby said plurality of pixels may be wholly or partially moved from a location overlying said array of display pixels to said non-displayed pixel spaces.

3. The system of claim 1 further comprising means responsive to a bit map of said bit mapped cursor for selecting as a color for an overlying cursor pixel between a first pre-determined color and a second predetermined color from a selection of at least three different colors.

4. The system of claim 1 further comprising means responsive to a bit map of said bit mapped cursor for selecting as a color for an overlying cursor pixel between a first pre-determined color, a second pre-determined color, and a color that is the same as that of its underlying pixel and different from said pre-determined color from a selection of at least three different colors.

5. The system of claim 1 further comprising means responsive to a bit map of said bit mapped cursor for selecting as a color for an overlying cursor pixel between a first pre-determined color, a second pre-determined color, a color that is the same as that of its underlying pixel and a color that is a logical inversion of a color of its underlying pixel.

6. The system of claim 3, wherein said bit mapped cursor is located in a frame buffer memory at addresses other than those scanned to provide said array of display pixels.

7. The system of claim 4, wherein said bit mapped cursor is located in a frame buffer memory at addresses other than those scanned to provide said array of display pixels.

8. The system of claim 5, wherein said bit mapped cursor is located in a frame buffer memory at addresses other than those scanned to provide said array of display pixels.

9. The system of claim 6, wherein said bit map has a first bit mapped plane and a second bit mapped plane such that each cursor pixel has two data bits that are used by said color selecting means to select its color.

10. The system of claim 7, wherein said bit map has a first bit mapped plane and a second bit mapped plane such that each cursor pixel has two data bits that are used by said color selecting means to select its color.

11. The system of claim 8, wherein said bit map has a first bit mapped plane and a second bit mapped plane such that each cursor pixel has two data bits that are used by said color selecting means to select its color.

12. A system for displaying a bit mapped cursor within an array of display pixels, said bit mapped cursor having a plurality of pixels arranged in a rectangular block and one of said plurality of pixels is pre-determined to be a reference pixel, comprising the steps of:

providing a vertical non-displayed pixel space logically located above and adjoining said array of display pixels, said vertical non-displayed pixel space begins a period of time that is equivalent to a period of at least one horizontal scan line before a vertical frame of said display pixels begins;

providing a horizontal non-displayed pixel space logically located before and adjoining said array of display pixels, said horizontal non-displayed pixel space begins a period of time that is equivalent to a period to horizontally scan at least one pixel before a horizontal scan line of said display pixels begins;

storing a pre-determined vertical location that is located within said array of display pixels as a vertical location of said reference pixel;

storing a pre-determined horizontal location that is located within said array of display pixels as a horizontal location of said reference pixel;

processing said vertical location and said horizontal location for determining those cursor pixels of said plurality of pixels that will be displayed because they are overlying said array of display pixels and also determining those cursor pixels that will not be displayed because they are located in said non-displayed pixel spaces; and controlling the display of said array of display pixels if there are no overlying cursor pixels and the display of cursor pixels if there are overlying cursor pixels.

13. The method of claim 12 further comprising the step of controlling a color section for an overlying cursor pixel from between a first-pre-determined color and a second pre-determined color by a bit map of cursor pixel information from a selection of at least three different colors.

14. The method of claim 12 further comprising the step of controlling a color section for an overlying cursor pixel from between a first-pre-determined color, a second pre-determined color and a color that is the same as that of its underlying pixel by a bit map of cursor pixel information and different from said predetermined colors from a selection of at least three different colors.

15. The method of claim 12 further comprising the step of controlling a color selection for an overlying cursor pixel from between a first pre-determined color, a second pre-determined color, a color that is the same as that of its underlying pixel and a color that is a logical inversion of a color of its underlying pixel by a bit map of cursor pixel information.

* * * * *

UNITED STATES PATENT AND TRADEMARK OFFICE

CERTIFICATE OF CORRECTION

PATENT NO. : 5,146,211

DATED : September 8, 1992

INVENTOR(S) : John M. Adams, et al.

It is certified that error appears in the above-identified patent and that said Letters Patent is hereby corrected as shown below:

Column 14, after line 42, insert omitted paragraph --means for storing a pre-determined vertical location that is located within said array of display pixels as a vertical location of said reference pixel;--.

Column 14, line 43, delete "vertical" and insert --horizontal--.

Column 14, line 60, "extend" should be --extent--.

Column 14, line 61, "extend" should be --extent--.

Column 15, line 47, delete "system" and insert --method--.

Column 16, line 31, "section" should be --selection--.

Column 16, line 37, "section" should be --selection--.

Signed and Sealed this

Fourteenth Day of September, 1993

Bruce Lehman

*Attest:*

BRUCE LEHMAN

*Attesting Officer*

*Commissioner of Patents and Trademarks*